United States Patent [19]

Peterson

[11] 4,155,242

[45] May 22, 1979

[54] CORE TOOLS

[75] Inventor: Bruce E. Peterson, Acushnet, Mass.

[73] Assignee: Double E Company, Inc., Brockton, Mass.

[21] Appl. No.: 859,960

[22] Filed: Dec. 12, 1977

[51] Int. Cl.[2] ..... B21D 41/02

[52] U.S. Cl. ..... 72/392; 72/453.16; 254/124

[58] Field of Search ..... 72/392, 409, 453.15, 72/453.16, 453.17; 29/252; 254/93 HP, 120, 124; 92/13.2, 43, 50, 37

[56] References Cited

U.S. PATENT DOCUMENTS

| | | | |
|---|---|---|---|
| 571,503 | 11/1896 | Baird | 72/453.15 |
| 3,635,440 | 1/1972 | Van Gompel | 254/124 |
| 3,888,003 | 4/1975 | Brown | 92/37 |

FOREIGN PATENT DOCUMENTS

| | | | |
|---|---|---|---|
| 519535 | 2/1931 | Fed. Rep. of Germany | 72/392 |

*Primary Examiner*—Lowell A. Larson

[57] ABSTRACT

A tool for insertion into a core including a pair of pivotally connected levers having forwardly-extending jaws for insertion into the core and rearwardly-extending actuating portions to which the opposite ends of a flexible-wall fluid actuator are fixed for applying force to the actuating arms and pivotally expanding the jaws.

13 Claims, 6 Drawing Figures

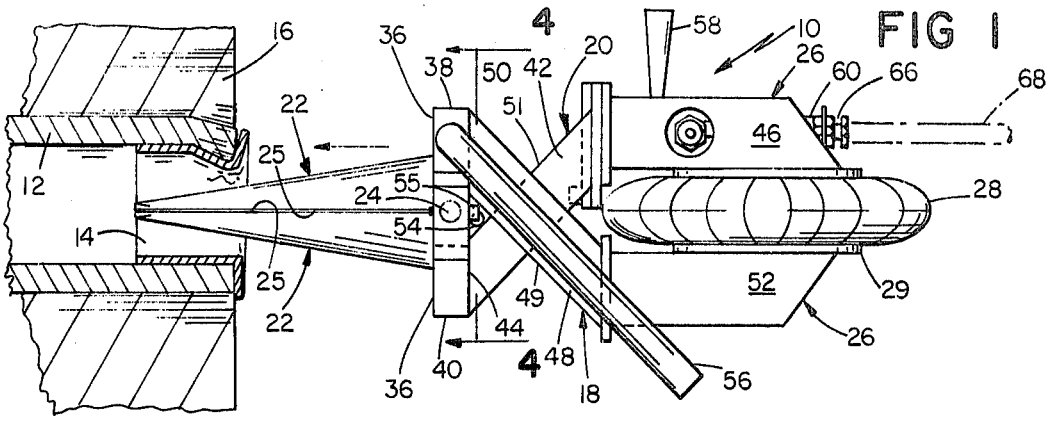
FIG 1
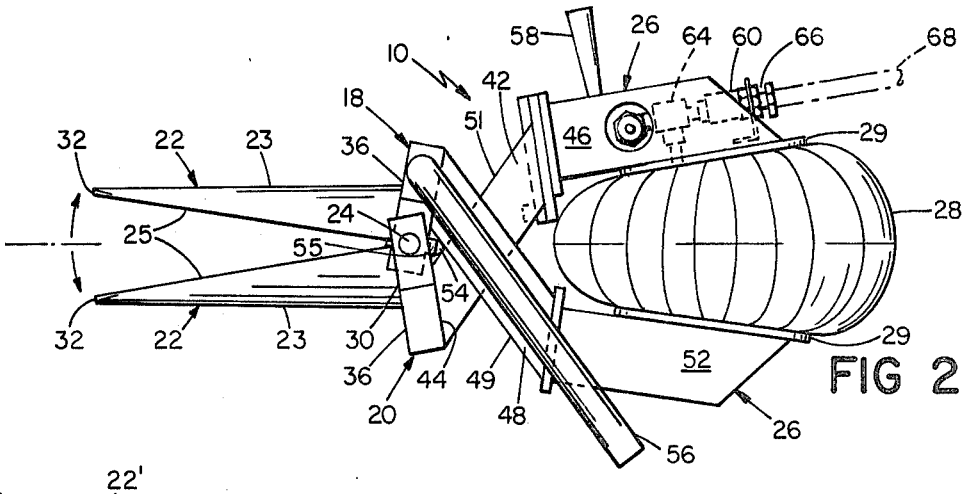
FIG 2
FIG 6
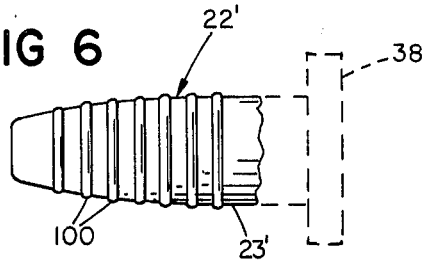
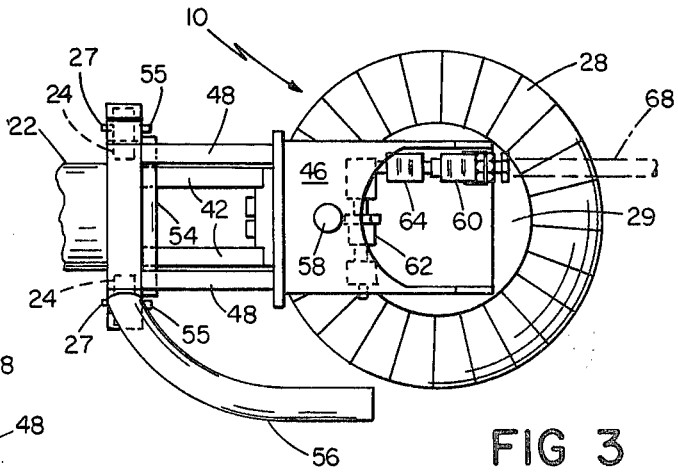
FIG 3
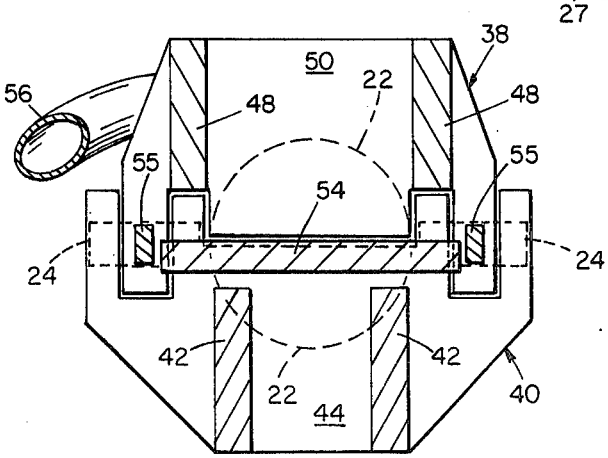
FIG 4
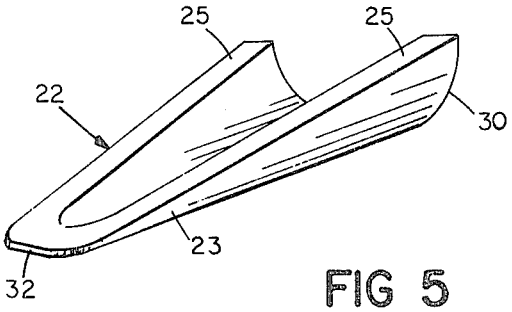
FIG 5

CORE TOOLS

BACKGROUND OF THE INVENTION

This invention relates to core tools and, more particularly, to tools for lifting rolls or expanding deformed or collapsed annular cores.

Paper, metal foil, sheets and the like are often rolled in coils on hollow cores for storage and handling. Such rolls are heavy and can be difficult to handle; and mishandling may partially collapse the cores and deform the rolls of material. Before the rolled material can be used in its normal and intended manner, the roll and core, and end cap if any, must be restored to annular shape. Obviously, the restoration should be accomplished in a manner which does not damage the core or material rolled thereon, and which requires a minimum cost in manpower and machine down-time. Many devices have been proposed to accomplish such restoring, but all have been subject to some limitations or drawbacks. Principle shortcomings have been the inability continuously to apply force to a crushed core as it is expanded back into shape and shock-set, the rather limited expanding force that can be applied by tools of manageable size, and the inability to rapidly apply and then release force.

SUMMARY OF THE INVENTION

It is a principal object of the present invention to provide lightweight tool which will apply a large force to the inside of a core, either to permit the roll to be lifted or to expand the core if crushed or deformed. Other objects include providing such a core expander device which can continuously apply force to the inside of a crushed core as the core is expanded, can be rapidly cycled, avoids the problems of leakage and seal failure associated with existing hydraulic units, and in which over-expansion is prevented.

The invention features a tool for insertion into a core including a pair of pivotally connected levers having forwardly-extending jaws for insertion into the core and rearwardly-extending actuating portions to which the opposite ends of a flexible-wall fluid actuator are fixed for applying force to the actuating arm and pivotally expanding the jaws. In preferred embodiments in which each of the jaws has an outer surface of diameter substantially equal to that of the core and is tapered for insertion into the core, the two levers are connected intermediate their length much like scissors, the actuator is a rubber bellows mounted between the actuating arms so that in response to inflation of the diaphragm it moves the jaws from a closed position in which the jaws are close together towards an open position in which the outer surfaces of the jaws are slightly divergent, control means including valving connected to a pressure-regulated fluid source continuously applies fluid under pressure to the bellows, an expansion stop prevents pivoting of the jaws beyond the predetermined open position, and the jaw surfaces may be ribbed if the device is to be used as a roll lifter.

Other objects, features and advantages will appear from the following detailed description of a preferred embodiment of the invention, taken together with the attached drawings in which:

FIGS. 1, 2 and 3 are plan views of a core expander embodying the invention;

FIG. 4 is a sectional view taken at 4—4 of FIG. 1;

FIG. 5 is a perspective view of a jaw of the device of FIG. 1; and

FIG. 6 is a view of a jaw for use on a roll lifter embodying the invention.

Referring now to FIGS. 1 through 5 of the drawings, there is shown a core expander, generally designated 10, for expanding the annular core 12 and end cap 14 of a roll of material 16. Expander 10 includes a pair of members 18, 20, pivotally connected by pins 24 intermediate their length, much like a pair of scissors. Each member includes a jaw 22 on one side of the pivot pins 24 and an actuating portion 26 on the other side. A flexible-walled actuator 28 (as shown, an Airstroke-brand actuator made by Firestone Industrial Products Co.) is positioned between, and the metal plates 29 forming its ends are bolted to, actuating portions 26. The members 18, 20 and actuator 28 are arranged so that, as shown in FIGS. 1 and 2, expansion of actuator 28 forces the actuating portions 26 apart, thereby pivoting jaws 22 at pins 24 relatively away from each other also. The flexible walls of the actuator 28 self-adjust to the changing angle between portions 26.

As illustrated most clearly in FIG. 5, each jaw 22 is shaped like a "duck bill," and has an outer peripheral surface 23 defined by a cylinder of diameter equal to or slightly less than the inner diameter of end cap 14 and tapering from a semi-cylindrical end 30 closely adjacent pivot pins 24 to a narrow leading edge 32, and a pair of circumferentially facing side edges 25. In the illustrated embodiment, each jaw 22 is made by cutting a hollow semi-cylinder along a plane (defining side edges 25) inclined relative to the cylinder's axis, and then cutting end 30 in a plane perpendicular to surfaces 25 to form jaw end surface 34.

End surface 34 of each of jaws 22 is welded to the front face 36 of a respective pivot plane 38, 40, so that the side edges 25 of each jaw are perpendicular to the respective pivot plate face 36. The adjacent sides of plates 38, 40 intermesh as shown in FIG. 4 and are pivotally attached to each other by pins 24 held in place by set screws 27. The arrangement of the jaws 22 and plates 38, 40 is such that the outer surfaces 23 of both jaws will slightly converge (i.e., the distance between the extreme top and bottom of the jaws will be slightly less at ends 32 than at ends 30) when the jaws are pivoted apart in their open position (FIG. 2). In the closed position, when the jaws are pivoted together as in FIG. 1, the circumferential edges 25 are in face-to-face engagement.

The actuating portion 26 of member 20 includes a pair of transversely spaced arms 42 projecting angularly upwardly and rearwardly from the back face 44 of plate 40 and a bracket 46 extending between arms 42 and attached to the metal plate 29 at the top of actuator 28. The bracket 46 and arms 42 are bolted together to permit assembly. Actuating portion 26 of member 18 includes a pair of similar transversely spaced arms 48 which project annularly rearwardly and downwardly from the back face 50 of plate 38, passing between arms 42, and a permanently attached bracket 52 extending between arms 48 and attached to the metal plate 29 at the bottom of actuator 28. A cylindrical stop rod 54 is inserted through the gap between the crossed arms 42, 48 and the rear of plates 38, 40 in position to engage the upper side edges 51 of arms 42 and the lower side edges 49 of arms 48 and limit the extent to which jaws 22 can be pivoted apart to that shown in FIG. 2. Projecting stops 55 on the back of plate 38 retain rod 54 axially in place.

For ease in handling expander 10, handle 56 is attached to and extends annularly downwardly from the side of plate 38 and a second handle 58 is attached to and extends upwardly from the top of bracket 46.

Air under pressure is supplied to actuator 28 by a three-way slide valve 60 mounted on bracket 46 with its input port connected to a snap coupling 66 for an air hose 68, its output port 70 connected through a tee 64 to the inlet to actuator 28 and a pressure relief valve 62, and its exhaust port open. The pressure of air supplied to the actuator is controlled by a regulator either between coupling 66 and valve 60 or upstream.

In operation, the jaws 22 of expander 10 are inserted as far as possible into a crushed core or end cap, as shown in FIG. 1, until the crushed portion of the core engages the jaws (or the front surfaces 36 of plates 38, 40 engage the end of the core). The pressure regulator is set to provide air at the desired pressure, typically about 80 p.s.i. to valve 60; and the valve 60 is thrown to permit air under pressure continuously to flow through the valve and into actuator 28. The air-under-pressure expands the actuator 28 and forces jaws 22 pivotally apart until they reach the position shown in FIG. 2, in which the distance between the top and bottom of the jaws is about equal (but for the slight divergence earlier mentioned) to the desired inside diameter of the core 12 or end cap 14. The jaws may be closed simply by switching valve 60 to its exhaust configuration. Stop rod 54 engages the side edges of arms 42, 48 and prevents members 18, 20 from being pivoted apart beyond the FIG. 2 position, thus acting as a safety stop when jaws 22 are not inside a core and preventing overexpansion of relatively weak cores.

As previously indicated, devices having the general construction of expander 10 may also be used as roll lifters. When designed for such use, the modified jaw 22' shown in FIG. 6 is substituted for jaws 22, and an eye bolt (not shown) is substituted for handle 58. As shown, jaw 22' is substantially identical to jaw 22, except that its peripheral surfaces 23' are not smooth but include a plurality of axially spaced circumferential ribs 100. To lift a heavy roll of paper, metal foil or the like, jaws 22' are inserted into the roll core and expanded, and the roll and tool are then lifted by an overhead crane whose hook is inserted in the eyebolt. As will be evident, ribs 100 help insure that the roll does not slip axially off the jaws.

I claim:

1. A core tool comprising:

a pair of pivotally connected levers having forwardly-extending jaws for insertion into a core and rearwardly extending actuating portions, said jaws being pivotally movable between a closed position in which the outer surfaces of jaws converge forwardly and an open position in which the jaws are pivoted relatively apart;

a flexible-walled actuator positioned between said actuating portions and having its end fixedly connected to the actuating portions and arranged to apply force to the actuating portions for pivoting the jaws from their closed position towards their open position when fluid under pressure is applied to the actuator.

2. The tool of claim 1 wherein the ends of the actuator comprise plates fixed to said actuating portions.

3. The tool of claim 1 including means for connecting the actuator to a source of fluid under pressure and continuously supplying fluid under pressure to said actuator as said jaws are moved toward their open position, and valving for controlling flow of fluid from said source to said actuator.

4. The tool of claim 1 wherein the outer surface of said jaws is defined by a portion of a cylinder of predetermined diameter and when the jaws are in their said open position the distance between said outer surfaces of said jaws is about equal to the diameter of said cylinder of said predetermined diameter.

5. The tool of claim 1 including stop means arranged to engage the said actuating portions and preventing pivoting movement of said jaws away from each other beyond a predetermined position.

6. The tool of claim 1 wherein each of said jaws is attached to one face of a respective plate, the plates are pivotally connected together, each of said actuating portions includes an arm extending from the opposite face of the respective plate and attached to said actuator, and said arms cross each other.

7. The tool of claim 6 wherein each of said actuating portions includes a bracket attached to the arm thereof and to said actuator.

8. The tool of claim 6 including control means comprising a connector for connection to a source of fluid under pressure, and a control valve for controlling flow or fluid from said connector to said actuator and from said actuator to an exhaust.

9. The tool of claim 8 wherein said control means includes means for regulating the pressure of fluid supplied to said actuator.

10. The tool of claim 6 wherein each of said actuating portions includes a pair of transversely-spaced said arms and the two pairs of arms cross each other.

11. The tool of claim 10 including a stop mounted in the gap between and defined by said pairs of arms and said plates, said stop arranged to engage edges of said arms and preventing relative pivoting of said jaws away from each other beyond a predetermined position.

12. The tool of claim 11 wherein said stop is a rod restrained against axial movement but otherwise free to move in said gap.

13. The tool of claim 1 wherein the outer surface of said jaw is defined by a portion of a cylinder having a plurality of axially-spaced circumferential ribs.

* * * * *

UNITED STATES PATENT AND TRADEMARK OFFICE

CERTIFICATE OF CORRECTION

PATENT NO. : 4,155,242

DATED : May 22, 1979

INVENTOR(S) : Bruce E. Peterson

It is certified that error appears in the above-identified patent and that said Letters Patent are hereby corrected as shown below:

Column 2, line 36, "plane" should be --plate--

Column 4, line 4, "end" should be --ends--.

Signed and Sealed this

*Fifth* Day of *August 1980*

[SEAL]

*Attest:*

SIDNEY A. DIAMOND

*Attesting Officer*

*Commissioner of Patents and Trademarks*